United States Patent [19]

Hartel et al.

[11] 4,398,866

[45] Aug. 16, 1983

[54] COMPOSITE CERAMIC/METAL CYLINDER FOR GAS TURBINE ENGINE

[75] Inventors: Edward O. Hartel, Orange; Zoltan L. Libertini, Stamford; Joseph C. Manente, Jr., Monroe; Donald E. Wilson, Derby, all of Conn.

[73] Assignee: Avco Corporation, Stratford, Conn.

[21] Appl. No.: 276,843

[22] Filed: Jun. 24, 1981

[51] Int. Cl.[3] ..... F01D 5/08

[52] U.S. Cl. ..... 415/180; 415/177; 415/197; 415/174

[58] Field of Search ..... 415/138, 174, 180, 197, 415/117, 196, 119

[56] References Cited

U.S. PATENT DOCUMENTS

| | | | |
|---|---|---|---|
| 2,576,860 | 11/1951 | Shaprio | 415/119 |
| 3,589,475 | 6/1971 | Alford | 415/119 X |
| 3,601,414 | 8/1971 | Rao | 277/96 |
| 3,825,365 | 7/1974 | Peng | 415/117 |
| 3,947,145 | 3/1976 | Michel et al. | 415/138 X |
| 4,008,978 | 2/1977 | Smale | 415/134 |
| 4,087,199 | 5/1978 | Hemsworth et al. | 415/197 X |
| 4,207,024 | 6/1980 | Bill et al. | 415/196 X |

FOREIGN PATENT DOCUMENTS

| | | | |
|---|---|---|---|
| 25690 | of 1907 | United Kingdom | 415/174 |
| 733918 | 7/1955 | United Kingdom | 415/174 |
| 2051962 | 1/1981 | United Kingdom | 415/197 |

*Primary Examiner*—Philip R. Coe
*Assistant Examiner*—Frankie L. Stinson
*Attorney, Agent, or Firm*—Ralph D. Gelling

[57] ABSTRACT

A cylinder of a gas turbine engine is formed of a multi-layered construction including a radially inner ceramic ring, the inner surface of which is juxtaposed to the tips of a turbine rotor, an intermediate arrangement of two annular ceramic rings that are substantially L-shaped in cross-section and are disposed in mirror image so as to entrap the radially inner ceramic ring, and a radially outer metallic support means which envelopes the intermediate ceramic rings for maintaining the composite ceramic structure during different operating modes of the turbine engine. The composite ceramic portion of the cylinder enables the engine to operate at higher temperatures, and offers the potential for improved turbine tip clearance control, since the ceramic material is less sensitive to thermal distortion.

4 Claims, 2 Drawing Figures

COMPOSITE CERAMIC/METAL CYLINDER FOR GAS TURBINE ENGINE

BACKGROUND OF THE INVENTION

The subject invention relates to outer shrouds or cylinders for gas turbine engines, and more particularly, to an outer cylinder construction made of a composite of ceramic materials and metallic materials.

In order to operate gas turbine engines more efficiently, turbine inlet temperatures have continually been elevated into temperature ranges greater than 1800°-1900° F. where it is desirable to form the outer shroud components of the gas turbine engine of a high temperature ceramic material that is suitable to contain the elevated temperature combustion gases as they are directed from a high temperature combustor through the turbine stages of the engine. Due to their tolerance to hot gas path temperatures up to approximately 2500° F., ceramic materials generally offer the potential for more efficient engine operation, while permitting reduced cooling air requirements. In addition, a ceramic cylinder also offers the potential for turbine tip clearance control, since the ceramic material is generally less sensitive to thermal distortion as compared to metallic structures.

However, when ceramic materials interface with metallic structures, stresses are generated because of the different reactions of the materials to temperature. It is therefore the object of this invention to construct an assembly which utilizes ceramic materials in direct contact with the hot gases of a turbine engine and to secure the ceramic assembly in a manner which allows for relative movement between ceramic and metallic parts to compensate for thermal growth in the metallic structure.

SUMMARY OF THE INVENTION

In order to overcome the shortcomings inherent in the employment of a ceramic structure as a cylinder in a gas turbine engine, the subject invention provides a composite cylinder which is designed to include a layered structure to reduce thermal gradients and stress levels, while at the same time employing ceramic components having uniform heat-conducting and structural characteristics. The ceramic cylinder and support construction according to the subject invention uses three radial layers, the first of which is an inner ceramic ring; an intermediate assembly of front and rear symmetrical L-shaped ceramic rings disposed in mirror image for entrapping the inner radial split ceramic ring; and a metallic support structure. All of the ceramic rings may be formed by a casting process wherein a "green" ceramic is subsequently nitrided, and which are of a thickness on the order of 0.300 of an inch. Accordingly, the resulting ceramic rings have uniform structural and thermal characteristics throughout the cross-section thereof, and may be readily manufactured with a minimum amount of machining, thereby reducing the overall cost of the subject composite cylinder. When a split inner ceramic ring is used, the split should be sized so that the ends of the split ring do not touch under the most adverse transient conditions of operation of the gas turbine engine when the radially inner and outer rings have the greatest temperature differential.

The intermediate assembly of the front and rear symmetrical L-shaped ceramic rings effectively entrap the radially inner ceramic ring by engaging the inner ceramic ring about its radially outer surface and its axially spaced forward and trailing surfaces. The entrapment of the inner ceramic ring by the intermediate ceramic rings insures the structural integrity of the cylinder assembly of the subject invention in the event that the inner ceramic ring cracks. The contact surfaces between the ceramic rings are sized to limit the surface contact pressure within the constraints of the ceramic material. The outer metallic support structure provides a light spring pressure for maintaining the intermediate ceramic rings in contact with the inner ceramic ring. The metallic outer ring is also preferably provided with an initial spring preload so as to act as a damper to avoid vibration of the composite cylinder assembly. During operation of the gas turbine engine, maximum compression in the metallic spring should not produce an excessive load on the ceramic members, and additionally, the metallic spring is adjusted so as to be capable of extending to prevent the occurrence of axial gaps between the inner and intermediate ceramic rings which would cause excessive gas leakage. Further minimization of gas leakage is accomplished by using very smooth surface finishes on the ring components, growth tolerances and/or a compliant layer at the interfaces between the components.

A cooling system may be provided for cooling the outer metallic support structure and may be of the piston ring type as disclosed in U.S. patent application, Ser. No. 124,374, filed Feb. 25, 1980, by Edward Hartel or the labyrinth cooling arrangement as disclosed in U.S. patent application, Ser. No. 11,041, filed Feb. 9, 1979, by Edward Hartel, et al, both of which applications are assigned to the assignee of the subject application.

DETAILED DESCRIPTION OF THE DRAWINGS

Figure 1:
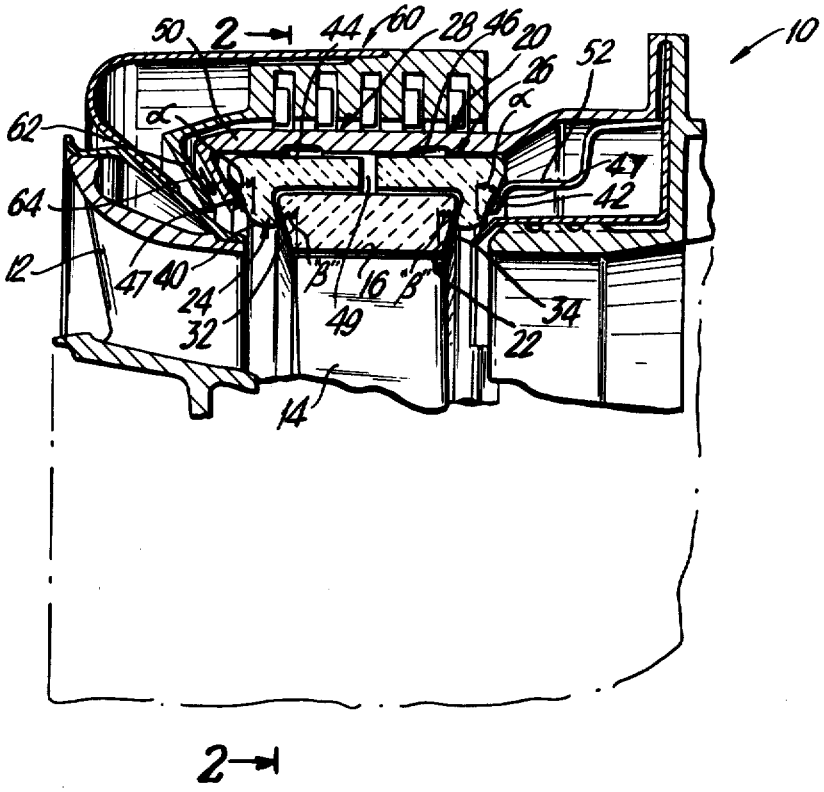
Figure 2:
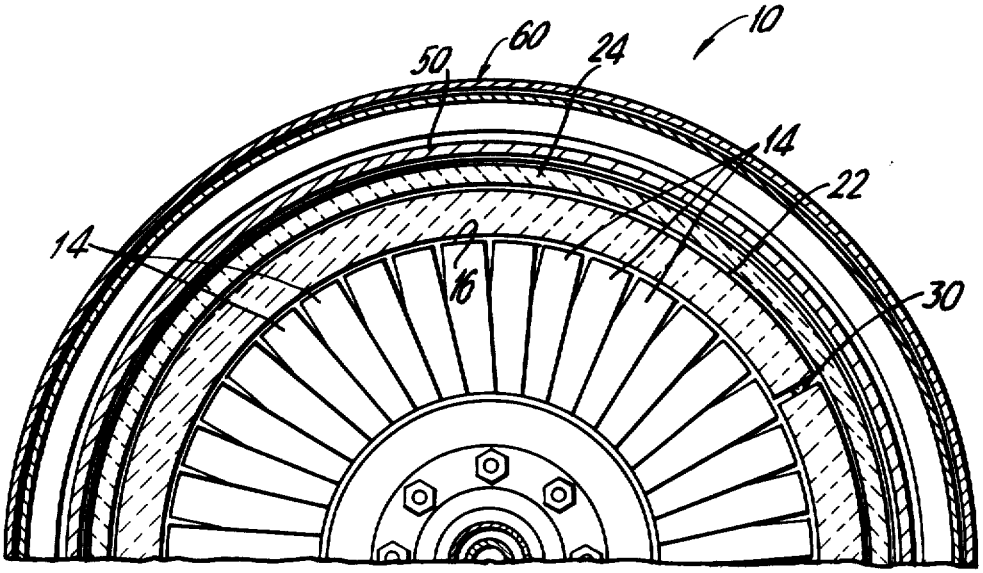

FIG. 1 is a cross-sectional view of the new and improved gas turbine engine cylinder according to the subject invention; and FIG. 2 is a cross-sectional view taken along line 2—2 in FIG. 1.

DESCRIPTION OF THE INVENTION

Turning to FIG. 1, a gas producer turbine assembly is designated by the numeral 10 and is connected to the combustion chamber (not shown) by an annular combustor outlet leading to the first stage stator vanes 12. The combustion gases are provided to the turbine and initially encounter the first stage stator 12, followed by the first stage blades 14 of the turbine rotor. Extending about and surrounding the tips 16 of the blades 14, is the annular shroud or cylinder 20 of the subject invention which basically comprises a radially inner ceramic ring 22, a pair of intermediate, L-shaped ceramic rings 24, 26 and a metal support structure designated by the numeral 28. The radially inner ceramic ring 22 may be split at 30 (see FIG. 2) to reduce load, and has a generally trapezoidal cross-section, as shown in FIG. 1. The forward and trailing surfaces 32 and 34 of the ceramic ring 22 are tapered inward to define an entrapment angle "B" relative to a plane extending normal to the longitudinal axis of the gas turbine engine. The entrapment angle "B" may be in a range of 0° to 45°, and preferably on the order of 10°-15°.

Each of the intermediate ceramic rings 24 and 26 includes radially inward extending portions 40 (42) as well as a cylindrical base 44 (46). As shown in FIG. 1, radial portion 40 (42) and base 44 (46) form a substantially L-shaped cross-section for the intermediate ceramic rings 24 and 26. The intermediate rings are positioned in axially spaced, opposing relationship. For convenience, the rings 24 and 26 are constructed as identical but reversed shaped pairs and are assembled to form an annular receptacle to accommodate the ceramic ring 22. The walls of the receptacle are formed by radial portions 40 and 42 and are angled inward to engage the surfaces 32 and 34 of ring 22 in an entrapping relation. The outer leading and trailing surfaces of radial portions 40 and 42 are inclined at a growth correction angle, designated "A", relative to a plane extending normal to the longitudinal axis of the gas turbine engine. The growth correction angle "A" is in the range of 0° to 45° and preferably on the order of 10° to 15°.

The supporting structure 28 for the assembled ceramic rings 22, 24 and 26 comprises a primary metal support 50 and a metal spring component 52. Elements 50 and 52 are adapted to clamp the leading and trailing surfaces of radial portions 40 and 42 of the ceramic rings 24 and 26 to secure the cylinder assembly together. The metal to ceramic contact areas at the leading and trailing faces of the radial portions 40 and 42 of the intermediate rings 24 and 26 should have a good surface finish to reduce friction. In addition, it may be desirable to insert a layer 47 of compliant material to further reduce friction and minimize leakage. The compliant layer may be constructed of thin, soft metal plate or strips. The support structure 28 effectively clamps the rings in place and spring component 52 is preferably preloaded with some initial deflection so as to act as a damper thereby minimizing vibration of the components of the cylinder 20 during operation of the engine.

In order to provide supplementary cooling to the metallic portion 28 of the cylinder 20, a piston type cooling arrangement 60 of the type as disclosed in U.S. application Ser. No. 124,374, filed Feb. 25, 1980, by Edward Hartel, and assigned to the assignee of the subject application, may be provided. The cooling arrangement 60 includes a flow director 62 for directing cool air, designated by the arrow 64 to the cylinder 20. Alternatively, a cooling matrix assembly as disclosed in U.S. application, Ser. No. 11,041, by E. Hartel, et al, and also assigned to the assignee of the subject application, may be provided in lieu of the piston ring arrangement 60.

The growth correction angle "A" is selected as a function of the maximum allowable spring deflection of the metallic support structure 28, and more particularly the flexible metal spring 52, and any load limitations associated with the metal to ceramic contact points. The entrapment angle "B" is selected so as to insure that the inner surfaces of ceramic rings 24 and 26 are in contact with the outer surfaces of the ceramic ring 22, especially the outer surfaces of the leading and trailing sides 32 and 34. This is necessary in order to retain the inner ceramic ring 22 in case it cracks during operation of the gas turbine engine. In addition, to insure this engagement, ceramic rings 24 and 26 are in axially spaced relationship to define a gap 49, (see FIG. 1), and to allow said rings to slide axially relative to one another. Abutment of the rings is to be avoided so that the entrapping relation is not lost.

As noted above, although the ceramic rings 22, 24 and 26 do not require cooling, some cooling is required for the metal support structure 28. Cooling air from the piston ring assembly 60 is directed by the airflow detector 62 and is mixed with the hot gases which inadvertantly bypass the blade 14 in the region of the contact area between the intermediate ceramic ring 24 and the inner ceramic ring 22. The mixed gases flow in between the juxtaposed surfaces of the inner ring 22 and the ceramic rings 24 and 26. The mixture of hot and cold air flows rearward in between the base portion 46 of the intermediate ceramic ring 26 and the inner ceramic ring 22. Accordingly, the cooling air from the piston ring system 60 is used to lower the temperature of the gas and air mixture that leaks through the ceramic assembly, and at the same time is effective to cool the metallic support structure 28.

The provision of the thermal growth angle "A" compensates for the different coefficients of thermal expansion between the metal support structure 28 and the ceramic rings 24 and 26, and helps maintain the desired amount of contact between the metallic and ceramic structures as the latter members are axially and radially displaced during various operating conditions of the gas turbine engine. In this manner the thermal growth of the components will not overpressure the cylinder structure 20. Preferably, the growth correction angles "A" are on the order of 10° to 15°.

The entrapment angles "B" are designed to center and position the inner ceramic ring 22 relative to the two ceramic rings 24 and 26, and are designed to support the ring 22 in the event of a crack or split therein due to wear or age. The entrapment angles "B" insure that even if the ceramic ring 22 were to become segmented in several parts, it would be held in its radially outward position beyond the tips 16 of the rotating blades 14 during operation of the gas turbine engine.

As noted above, the inner ceramic ring 22 may be split so as to allow the inner ring to grow circumferentially without growing radially outward which would result in a radial load applied to the intermediate ceramic rings 24 and 26 and the metal structure 28 of the cylinder 20. In effect, the inner ceramic ring 22, being split at 30, provides a buffer to the overall cylinder assembly 20 in response to rapid increases in temperature, at which time the split or gap 30 will close thereby enabling thermal expansion of the split ring 20, without causing stress to be applied on the remaining portions of the cylinder 20 by radially outward thermal expansion of the ring 22. Accordingly, the split ceramic ring 22 enables the cylinder 20 to have a fast response to rapidly changing temperature conditions in the gas turbine engine, while the remaining portions of the cylinder assembly respond at a slower rate, thus maintaining the structural integrity of the entire cylinder assembly. It is noted that ceramic materials are capable of operating in temperature ranges up to 2,500° F., whereas normally metal structures are only capable of operating in the range of 1800°-1900° F. Accordingly, the composite assembly 20 according to the subject invention, employing radially inner ceramic rings (having high temperature capability but being of relatively fragile structural capability) and radially outer metallic support structure (which is capable of accommodating high structural loads but lower temperature loads) provides a new and improved cylinder assembly capable of operating at higher temperatures thereby enabling the gas turbine engine to operate more efficiently and at higher temperature ranges.

Although the invention has been described and illustrated with respect to a preferred embodiment, it is readily apparent that those skilled in the art will be able to make numerous modifications, changes and alterations therein without departing from the spirit and scope of the invention. All such modifications are intended to be included within the spirit and scope of the invention as defined by the appended claims.

What is claimed is:

1. A gas turbine engine cylinder forming a portion of the turbine assembly surrounding the tips of a plurality of blades of a rotor, said cylinder comprising:

an inner ceramic ring having a radially inner surface which is spaced from the tips of said rotor blades forward and trailing surfaces extending radially outward from said inner surface, and an outer surface extending axially between said forward and trailing surfaces, the cross-section of said inner ceramic ring being trapezoidal in shape with the sides thereof, formed by the forward and trailing surfaces, tapering inward as said surfaces approach the radially inner surface of said inner ceramic ring;

a pair of intermediate, ceramic rings, each of said rings having a substantially L-shaped cross-section including an axially extending cylindrical base portion which is disposed parallel to the longitudinal axis of the turbine engine, and radially inward extending leg portions, each of said leg portions having axially spaced inner and outer surfaces, said rings being assembled in axially spaced, opposing relation to form an annular receptacle to receive and entrap the inner ceramic ring, said axial spacing forming a gap between said rings to assure a continuous contact with the inner ring, said inner surfaces of said leg portions engaging the forward and trailing surfaces of the inner ceramic ring and said outer surfaces of said leg portions being tapered inward as said surfaces approach the inner ceramic ring; and an outer support means disposed about and supporting said intermediate annular ceramic rings relative to said inner ceramic ring, said outer support means comprising an annular, metallic support clamp having radially inward extending flanges to engage and secure the intermediate ceramic rings in assembled position, at least one of the clamp flanges being constructed of spring metal and engaging the intermediate ceramic rings to bias said rings inward to maintain entrapping engagement between the intermediate ceramic rings and the inner ceramic ring.

2. A gas turbine engine cylinder forming a portion of a turbine assembly surrounding the tips of a plurality of blades of a rotor as in claim 1 wherein the inner ceramic ring is a split ring.

3. A gas turbine engine cylinder forming a portion of a turbine assembly surrounding the tips of a plurality of blades of a rotor as described in claim 1 wherein said inner surfaces of said leg portions are tapered inward to be generally parallel to the forward and trailing surfaces of the inner ceramic ring.

4. A gas turbine engine cylinder forming a portion of a turbine assembly surrounding the tips of a plurality of blades of a rotor as in claim 1 wherein the spring metal flanges of said outer support means is preloaded so as to function as a damper to minimize vibration of the cylinder assembly.

* * * * *